US010485059B2

(12) United States Patent
Bohlender et al.

(10) Patent No.: US 10,485,059 B2
(45) Date of Patent: Nov. 19, 2019

(54) PTC HEATING ELEMENT AND ELECTRIC HEATING DEVICE COMPRISING SUCH A PTC HEATING ELEMENT AND METHOD FOR PRODUCING AN ELECTRIC HEATING DEVICE

(71) Applicant: Eberspacher catem GmbH & Co. KG, Herxheim (DE)

(72) Inventors: Franz Bohlender, Kandel (DE); Patrick Kachelhoffer, Seebach (FR); Michael Niederer, Kapellen-Drusweiler (DE); Andreas Schwarzer, Frankfurt am Main (DE); Kurt Walz, Hagenbach (DE)

(73) Assignee: Eberspacher catem GmbH & Co. KG, Herxheim (DE)

( * ) Notice: Subject to any disclaimer, the term of this patent is extended or adjusted under 35 U.S.C. 154(b) by 522 days.

(21) Appl. No.: 15/169,873

(22) Filed: Jun. 1, 2016

(65) Prior Publication Data

US 2016/0360573 A1 Dec. 8, 2016

(30) Foreign Application Priority Data

Jun. 2, 2015 (EP) ..... 15170336

(51) Int. Cl.
*H05B 1/02* (2006.01)
*H05B 3/30* (2006.01)
(Continued)

(52) U.S. Cl.
CPC ..... *H05B 1/0236* (2013.01); *H05B 3/06* (2013.01); *H05B 3/18* (2013.01); *H05B 3/30* (2013.01);
(Continued)

(58) Field of Classification Search
CPC ..... H05B 1/0236; H05B 3/06; H05B 3/18; H05B 3/30; H05B 3/50; H05B 2203/017; H05B 2203/02
See application file for complete search history.

(56) References Cited

U.S. PATENT DOCUMENTS 7,676,144 B2 * 3/2010 Zeyen ..... F24H 3/0429 219/520
2007/0068913 A1 3/2007 Zeyen et al.
(Continued)

FOREIGN PATENT DOCUMENTS

EP 2 211 589 A1 7/2010
EP 2 397 788 A1 12/2011
EP 2 637 475 A1 9/2013

*Primary Examiner* — Shawntina T Fuqua
(74) *Attorney, Agent, or Firm* — Boyle Fredrickson, S.C.

(57) ABSTRACT

A PTC heating element includes at least one PTC element provided between strip conductors. To reduce the air gap and creep distance between the two strip conductors an insulating mass seals at least one of the strip conductors and/or the PTC element over the whole circumference. In the electric heating device according to the invention, such a PTC heating element lies in an electrically conducting manner against heat-emitting surfaces of the heating device. According to the method of the invention for producing an electric heating device, the strip conductors are glued to the PTC element for producing a PTC heating cell. The PTC heating cell is then sealed between two electrical insulation layers by an insulating mass which is applied circumferentially around at least one of the strip conductors and/or the PTC element.

11 Claims, 9 Drawing Sheets

(51) Int. Cl.

| | |
|---|---|
| ***H05B 3/50*** | (2006.01) |
| ***H05B 3/06*** | (2006.01) |
| ***H05B 3/18*** | (2006.01) |

(52) U.S. Cl.
CPC ..... *H05B 3/50* (2013.01); *H05B 2203/017* (2013.01); *H05B 2203/02* (2013.01)

(56) References Cited

U.S. PATENT DOCUMENTS

| | | | | |
|---|---|---|---|---|
| 2008/0099464 | A1* | 5/2008 | Niederer ..... | F24H 3/0405<br>219/520 |
| 2009/0020515 | A1 | 1/2009 | Clade et al. | |
| 2013/0163969 | A1 | 6/2013 | Bohlender et al. | |
| 2015/0215994 | A1 | 7/2015 | Bohlender et al. | |

* cited by examiner

PTC HEATING ELEMENT AND ELECTRIC HEATING DEVICE COMPRISING SUCH A PTC HEATING ELEMENT AND METHOD FOR PRODUCING AN ELECTRIC HEATING DEVICE

BACKGROUND OF THE INVENTION

1. Field of the Invention

The present invention refers to a PTC heating element with at least one PTC element provided between strip conductors.

2. Description of the Related Art

Such a PTC element is e.g. used in electric auxiliary heaters in automotive vehicles. These auxiliary heaters serve to heat air. They comprise corrugated rib layers lying against opposite sides of the PTC element. Plural layers of PTC elements, which are stacked one upon the other, with adjoining corrugated rib layers are provided as a rule. Examples disclosed in the prior art of such air heaters are for instance given in EP 1 768 459 A1, EP 2 109 345 B1 and EP 1 768 458 A1.

Generic PTC heating elements are however also used in heaters for heating liquid media, as are e.g. described in EP 1 921 896 A1.

The problem regarding good heat delivery arises as a rule. The PTC elements have self-regulating properties. If the heat generated by the PTC element is not dissipated in a satisfactory way, the electrical performance of the PTC element cannot be fully exploited.

SUMMARY OF THE INVENTION

The present invention is based on the problem to indicate an improved PTC element and an improved electric heating device. Furthermore, the present invention is suggested for producing an electric heating device.

To solve the problem regarding the device, it is suggested under a first aspect of the present invention that at least one of the strip conductors and/or the PTC element is sealed at the end side with an electrically insulating mass.

Especially in high-voltage applications, e.g. during installation of the PTC heating element in an electric heating device for an electrically driven automotive vehicle, there is the problem of electric flashovers, e.g. caused by air gaps and/or creep distances. This problem is countered with the present invention in that at least one of the strip conductors, preferably said one strip conductor and the PTC element lying against it at one side, is sealed at the end side into a mass. The free front side of the strip conductors is normally fully received in the mass. The front side of the PTC element can just be received in part in the mass and thus be covered by said mass. The strip conductor normally ends flush with the outer circumferential surface of the PTC element. Only electrical connecting lugs project at one side beyond the PTC element as a rule. These connecting lugs are positioned at opposite ends of the PTC element and serve to power the element with different polarity.

This insulating mass normally comprises a silicone mass as a liquid phase. Preferably, the liquid phase is formed by an addition-curing 2-component silicone which cures at room temperature and cures in a forced manner under heat. The mass has a viscosity between 100 and 200 Pa s at 25° C. With a view to good flowability, gasoline or toluene is normally added as a diluter to the 2-component silicone to obtain a viscosity in a range between 4 and 15, preferably between 5 and 8 Pa s, at 25° C. The thermal conductivity of the mass (liquid phase+particles) is normally between 3.0 and 5.0 W/(m K). In the cross-linked state the component of the mass that forms the liquid phase should have a Shore A hardness of about 10-40 and a dielectric strength CTI>600. This liquid phase has normally added thereto a predetermined solids amount of high thermal conductivity. The thermal conductivity of the filler amount should be between 20 and 30 W(m K). The filler is preferably aluminum oxide. With a view to good flow properties, preference is given to spherical aluminum oxide with a mean grain size of about 4 to 6 μm. With a view to good thermal conductivity of the mass (liquid phase+filler amount) the mass has a filler amount of at least 50 vol. %, particularly between 85 and 95 vol. %.

The individual components of the PTC heating element are preferably joined by the insulating mass into a unit. The PTC heating element according to the present invention is preferably without a frame joining and/or surrounding the components.

According to a preferred development of the present invention the PTC element comprises an insulation layer projecting over the strip conductor at the end side, which with the strip conductor and/or the PTC element defines a receiving portion receiving the insulating mass. The insulation layer is an electrical insulation layer. It may consist of a hybrid film which comprises a polyimide film and an electrically insulating mass applied thereto, preferably, however, a mass of good thermal conductivity, as the second layer of the insulation layer. This mass preferably has the same material composition as the electrical insulating mass for sealing the strip conductor.

The insulation layer normally projects over the PTC element on all sides. A gusset which forms the above-mentioned receiving portion is thereby formed between the PTC element and the insulation layer. The electrically insulating mass can be introduced into said gusset-like receiving portion and can be cured there.

The PTC heating element according to the invention is produced as a separate component and fitted for insertion into an electric heating device, particularly for insertion into a U-shaped recess of a heater housing. This U-shaped recess preferably extends from a partition which separates a circulation chamber from a connection chamber. The U-shaped recess is provided within a heating rib which projects from the partition into the circulation chamber and confines the U-shaped recess in a fluid-tight manner relative to the circulation chamber. The recess just opens towards the connection chamber. The circulation chamber is here fitted to receive a liquid medium, i.e. sealed and provided with inlet and outlet nozzle for connection of the circulation chamber to a circuit for liquid medium. The electric heating device has a preferably tub-shaped housing base which encloses the circulation chamber between a housing bottom, the partition extending in parallel therewith and housing sidewalls extending at a right angle thereto. Connection nozzles used for connecting the electric heating device to a circuit for a liquid medium project from sidewalls of the housing base. These connection nozzles are sealingly connected to the housing sidewalls. The housing base may be made from plastic. The circulation chamber is made fluid-tight.

The filling volume of the circulation chamber in water heaters of the above-described type is between 450 ml and 200 ml, preferably between 400 ml and 220 ml and particularly preferably between 300 ml and 230 ml. This filling volume also comprises the filling volume of the nozzle. Each nozzle as such has a filling volume of about 7 ml. The illustrated embodiment is normally integrated in a cooling water circuit in a vehicle that has a volume of about 5 to 6 liters. At least one heat exchanger for heating air in the passenger compartment can be integrated into this cooling water circuit. In addition or alternatively, the cooling water circuit may also comprise heat exchanger surfaces for technical components of an electric vehicle to give these components the necessary operating temperature at cold ambient temperatures. Thus, the PTC element according to the invention is particularly used in a heater of an electrically driven automotive vehicle in which liquid medium is heated, for instance, to heat a unit or also the interior of the electrically driven vehicle. With such an application the PTC heating element is powered with a high voltage so that care must here particularly be taken that creep distances and/or air gaps are eliminated.

With a view to a highly heat-conducting introduction of the PTC element into such a U-shaped recess, the PTC element is preferably wedged in the recess, as is known from EP 2 637 475 A1 or EP 1 921 896 A1. To this end, according to a further preferred configuration of the present invention, a slide sheet is suggested that may be connected, e.g. glued, by virtue of the electrically insulating mass to the PTC element. This yields a prefabricated intermediate product which can be inserted as a unit into the U-shaped recess. The intermediate product consists of the PTC element and the strip conductors provided thereon at both sides. These strip conductors are normally formed by contact sheets. The strip conductors are connected, preferably glued, to the PTC element. Insulation layers are preferably provided at opposite free areas of the strip conductors. Thus the PTC heating element, i.e. the PTC element and the strip conductors adjoining it at both sides, is enclosed between the two insulation layers. The said slide sheet lies against one of the insulation layers.

The slide sheet projects preferably over the PTC element and also the strip conductors. Furthermore, the slide sheet projects preferably at the end side over one of the insulation layers and grips over said insulation layer with a leg which extends on the underside at a distance from the PTC element. An intermediate space formed thereby between the leg and the PTC element is fully or partly filled with the electrically insulating mass. The corresponding leg of the slide sheet preferably forms a stop which defines the penetration depth of the PTC heating element into the U-shaped recess.

The insulation layer projecting over the strip conductor at least on the underside defines a minimum distance between the slide sheet and the PTC element. This distance is preferably between 2.5 and 4 mm.

According to a preferred development of the present invention the slide sheet is formed at least by punching and bending from a sheet material and has a spacer formed by this processing. With this spacer the PTC heating element is kept at a predetermined distance from an inner surface of the U-shaped recess. Thus, the spacer is preferably dimensioned such that the PTC heating element lies against the inner surface of the U-shaped recess with interposition of the insulation layer, whereas at the opposite side the slide sheet confines the packet of PTC heating element and adjoining insulation layers on the outside, and the spacer projects from the side facing away from the PTC heating element and lies against the other inner surface of the U-shaped recess. Preferably, plural spacers are provided. The spacers can e.g. be formed by spring elements which can be provided in superposed fashion in the insertion direction of the PTC element into the U-shaped recess. Preferably, two spacers enclose thereinbetween an abutment or slide surface for a wedge element which clamps the PTC element in the U-shaped recess.

According to a preferred development of the present invention a sheet is provided that grips around the PTC element and the strip conductors at one side, e.g. on the underside. This sheet element may e.g. be formed by the slide sheet. The sheet element can form a lower stop by which the PTC heating element is predetermined in its end position in the U-shaped recess. The electrically insulating mass fills the space between the stop and the PTC element preferably completely or in part.

The slide sheet may be connected, for instance glued, to the PTC element. Normally, the slide sheet preferably forms a U-shaped receptacle for the PTC element together with the adjoining strip conductors and an insulation layer respectively confining said conductors on the outside. This prefabricated unit can here be held by way of clamping in the U-shaped receptacle.

According to a preferred development of the present invention the strip conductors project, in the insertion direction of the PTC element, over said element at least at one side and lie at the end side, preferably on an underside of the PTC element which is opposite to the connecting lugs, against a bar the thickness of which does not exceed the thickness of the PTC element plus the thickness of the two strip conductors. In this preferred configuration, the strip conductors are preferably formed by contact sheets which by way of punching comprise connecting lugs integrally formed thereon. The connecting lugs may extend through a further bar which is provided opposite to the first, previously described, bar and is also connected to the strip conductors. This upper bar normally comprises penetrations for the connecting lugs of the contact sheets. To avoid air gaps and creep distances between the end sections of the strip conductors projecting over the PTC element, the electrically insulating mass is provided between said end sections and the bar. The two other front faces, i.e. normally the longitudinal-side surfaces of the PTC element, also end here preferably flat with the strip conductors. The bar may comprise a central projection which forms abutment surfaces for the contact sheets.

According to the present invention the mass is provided surrounding the PTC element and/or the strip conductor. The mass is preferably applied as a glue bead sealing the PTC element and/or the strip conductors around said components. Preferably, the insulation layer, particularly preferably both insulation layers, form edges projecting over the PTC element at the edge. The electrically insulating mass is glued as an adhesive mass to said edges. The electrically insulating mass preferably extends around the PTC element. Likewise, the edges of the insulation layer project over the PTC element on all sides. Thus, a surrounding bead consisting of the electrically insulating mass, by which the PTC element is completely sealed, is obtained between opposite insulation layers. Only the connecting lugs pass through the insulating mass and are exposed at a connection side of the PTC heating element. The connecting lugs preferably project through a connection flange for holding and positioning the PTC heating element in the U-shaped recess. This connection flange is glued via the adhesive, electrically insulating mass to the PTC element. Thus, in this configuration, the PTC element and the adjoining strip conductors are preferably covered and sealed by the electrically insulating mass over the whole circumference.

According to a further aspect the present invention suggests an electric heating device, particularly for an automotive vehicle, with heat-emitting surfaces that accommodate at least one PTC heating element thereinbetween. This PTC element is preferably shaped according to one of the above-discussed configurations.

With its additional aspect the present invention further suggests a method for producing an electric heating device of the type generally disclosed herein. In this method, the strip conductors are glued to the PTC element for producing a PTC heating cell. The PTC heating cell produced in this way is placed between two electrical insulation layers and sealed by an electrically insulating mass. The electrically insulating mass can here first be placed on projecting edges of an insulating film forming the insulation layer. The PTC heating cell was previously placed on said film. The electrically insulating mass is thus applied around the PTC heating cell and onto the one layer of the film. The insulating film is then folded over for the sealing inclusion of the PTC heating cell and placed on the other one of the strip conductors. Thus, a circumferential surrounding of the PTC heating cell by the electrically insulating mass is achieved by the folding over of the insulating film. This mass then extends between the opposite inner surfaces of the insulating film and glues the two film sections preferably against each other. Excessive insulating mass can be pushed out at the front side over the PTC heating element. The PTC heating element which is prepared in this way and configured to be insulating on the outer circumference can then be inserted into a U-shaped recess of a heater and electrically insulated by casting with the electrically insulating mass, but can be used with good thermal conductivity.

BRIEF DESCRIPTION OF THE DRAWINGS

Further details and advantages of the present invention become apparent from the following description of an embodiment in combination with the drawing, in which.

DETAILED DESCRIPTION

Figure 1:
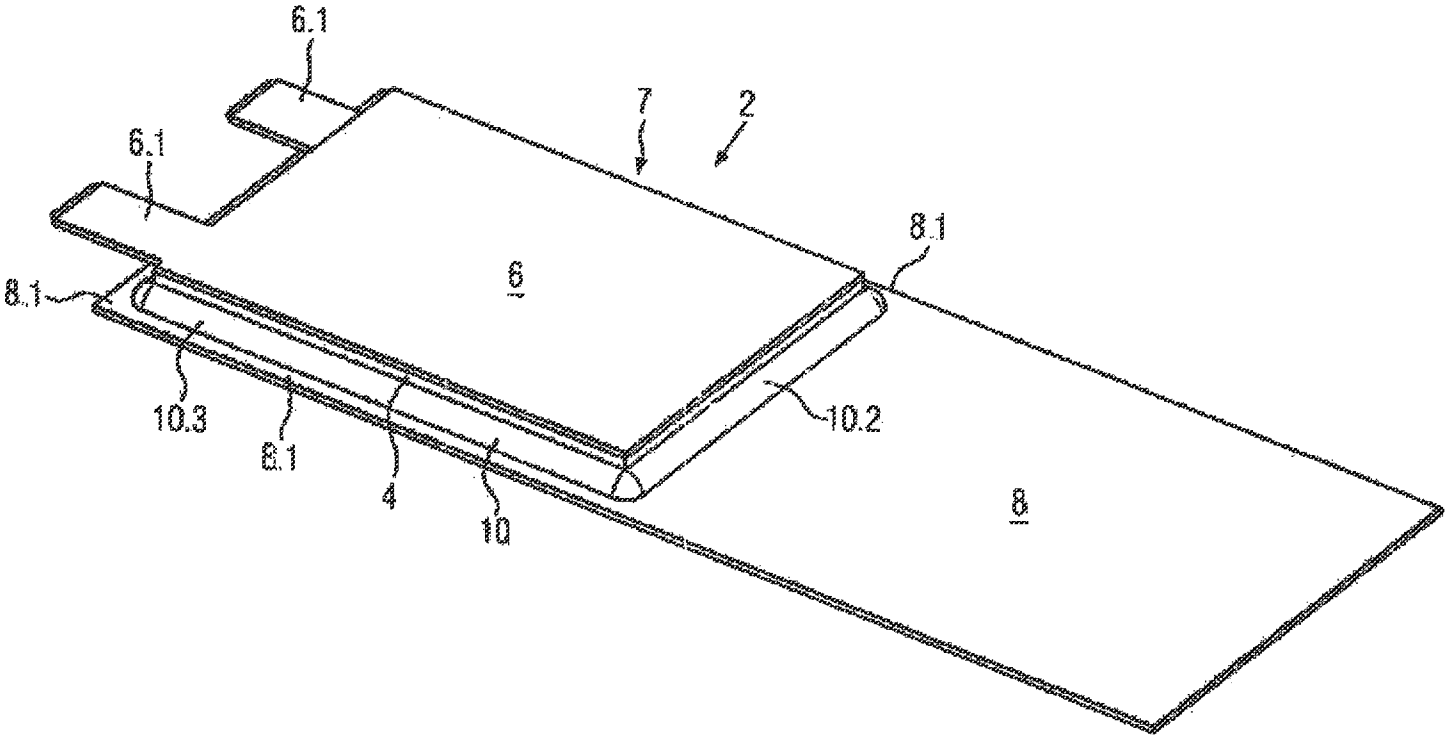
FIG. 1 is a perspective side view of a first embodiment of a PTC heating element.

FIG. 1 is a perspective side view of a PTC heating element 2 with a PTC element 4 which is arranged between two strip conductors 6 formed as contact plates of sheet metal. FIG. 1 just shows the upper one of the two contact plates 6. The PTC element 4 is positioned thereunder. The PTC element 4 and the two contact plates 6 have in principle the same base area. The contact plates 6 are just extended on the upper side beyond the PTC element 4 for the formation of a contact tab 6.1 which is integrally formed on the sheet element. The contact plate is connected for the formation of a PTC heating element to the PTC element 4 by way of an adhesive, preferably an electrically conductive adhesive. This prefabricated PTC heating cell 7 is placed on a hybrid film 8 which is broader than the PTC heating element 2. The hybrid film 8 consists of a relatively thin film which has an electrically non-conductive pasty mass applied thereto.

The PTC heating element 2 is placed on the web of the hybrid film 8 shown in FIG. 1. Since the insulation layer formed by the hybrid film 8 slightly projects over the PTC element in width direction, the hybrid film 8 forms respectively projecting edges 8.1 in width direction. The hybrid film 8 also projects over the PTC heating element 2 to a quite considerable extent on the underside thereof and to some degree on the upper side, i.e. at the place where the connecting lugs 6.1 are projecting. This results in edges 8.1 surrounding the PTC heating element 2. The electrically insulating, but thermally conductive mass 10 which is also used for producing the hybrid film 8 is applied as a bead to said edges 8.1. The electrically insulating mass 10 thereby lies at the end side against the exposed front-side edges of the two contact plates 6 which receive the PTC element 2 thereinbetween. The bead of insulating mass 10 is applied with an adequate volume, so that the height of the bead corresponds to about ½ to ⅘ of the height of the PTC element 4, plus the height of one of the two contact plates 6.

The hybrid film 8 is then folded over and placed on the top side of the upper contact plate 4 that is still exposed in FIG. 1. The adhesive bead formed from the mass 10 then contacts the hybrid film 8 and seals the PTC element 4 and/or one of the contact plates 6 over the whole circumference. Only the connecting lugs 6.1 penetrate this circumferentially electrically insulating inclusion of the PTC element.

Figure 2:
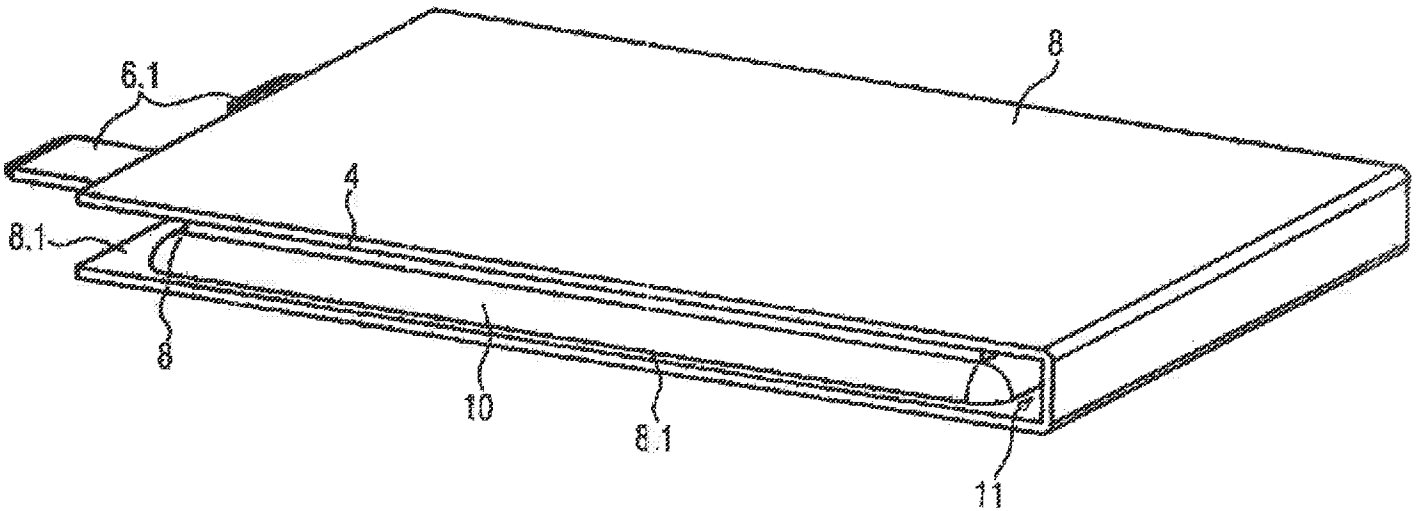
FIG. 2 is a perspective side view according to FIG. 1 after the folding over of the hybrid film.

FIG. 2 shows the embodiment according to FIG. 1 in a perspective side view after the folding over of the hybrid film 8. As can be seen, the hybrid film 8 projects over the bead of the mass 10 on all sides. Moreover, an accommodating portion 11 ensuing from the folding over of the hybrid film 8, which is made continuous in the width direction of the PTC heating element 2, is positioned on the underside of the PTC heating element 2 which is opposite to the connecting lugs 6.

Figure 3:
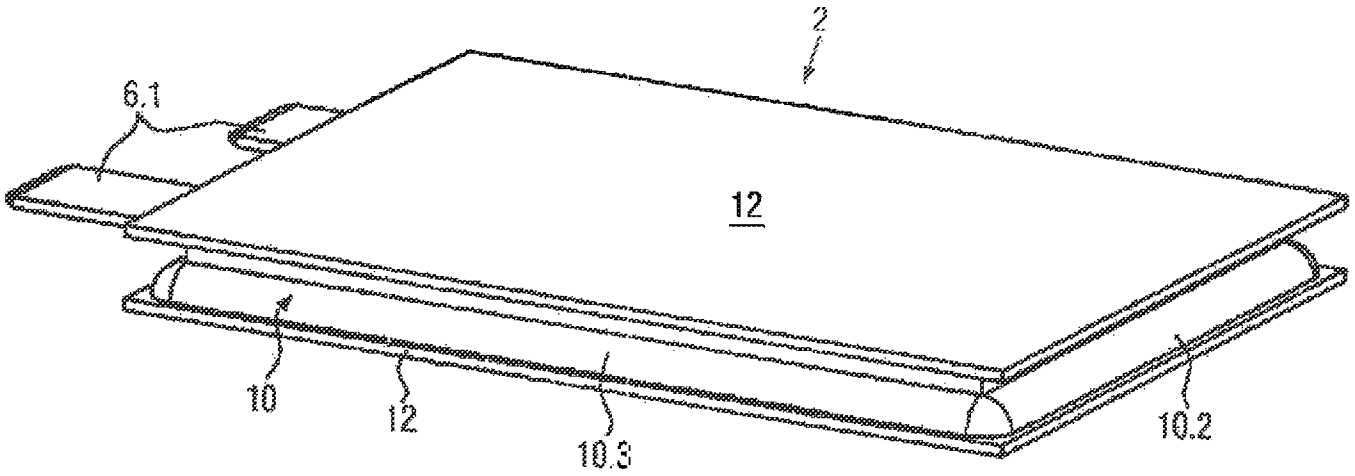
FIG. 3 is a perspective side view of a second embodiment of a PTC heating element.

FIG. 3 shows an alternative embodiment. Like components are marked with like reference numerals in comparison with the previously described embodiment.

The PTC heating element 2 according to FIG. 3 comprises two insulation layers extending in parallel with each other. These insulation layers 12 may be layers consisting of the previously mentioned hybrid film. Alternatively, insulation layers of a ceramic material and/or of a ceramic coated with a plastic film may also be provided. In this embodiment the mass 10 is also provided in the manner of a circumferential glue bead in such a manner that at least one of the strip conductors 6 is sealed by the mass 10 over the whole circumference and the PTC element 4 over the whole circumference, but not over the entire height thereof, but just up to a height of about ½ of the thickness of the PTC element 4.

Figure 4:
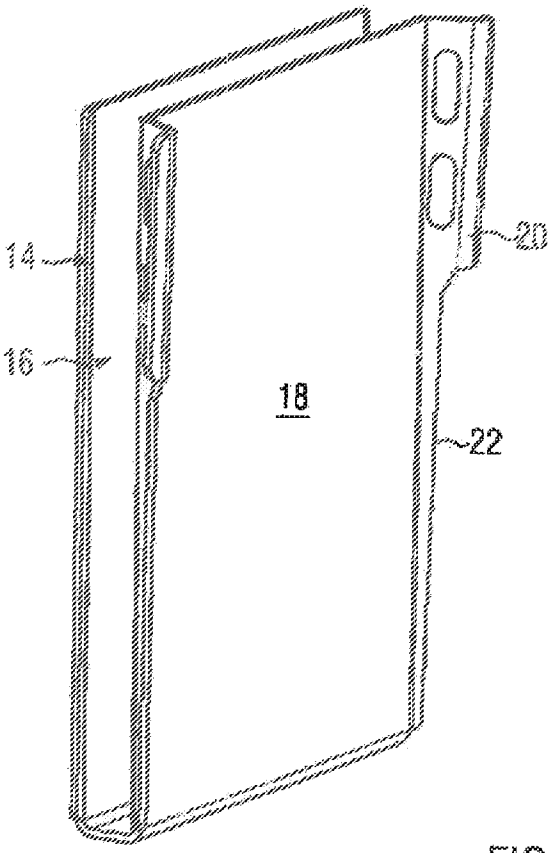
FIG. 4 is a perspective side view of an embodiment of a slide sheet.

FIG. 4 is a perspective side view of an embodiment of a slide sheet 14 which is bent over by being bent twice into a profile that is U-shaped in the side view. A U-shaped receptacle 16 formed thereby is dimensioned such that the embodiments of PTC heating elements as discussed above with reference to FIGS. 1 to 3 fit each into the U-shaped receptacle 16. On an outer surface, the slide sheet 16 forms a slide surface 18 over which spacers 20 project at both sides, the spacers being formed by bending the material which forms the slide sheet 14. The spacers 20 extend in longitudinal direction of the slide sheet 14, and they are just provided in the upper portion of the slide sheet 14. Inclined surfaces 22 that are tapering in funnel-shaped fashion obliquely towards the slide surface 18 and slightly protrude beyond said slide surface 18 are provided as an extension of said spacers 20. The spacers 20 and the inclined surfaces 22 form a lateral boundary of a wedge element marked in FIG. 5 with reference numeral 24.

Figure 5:
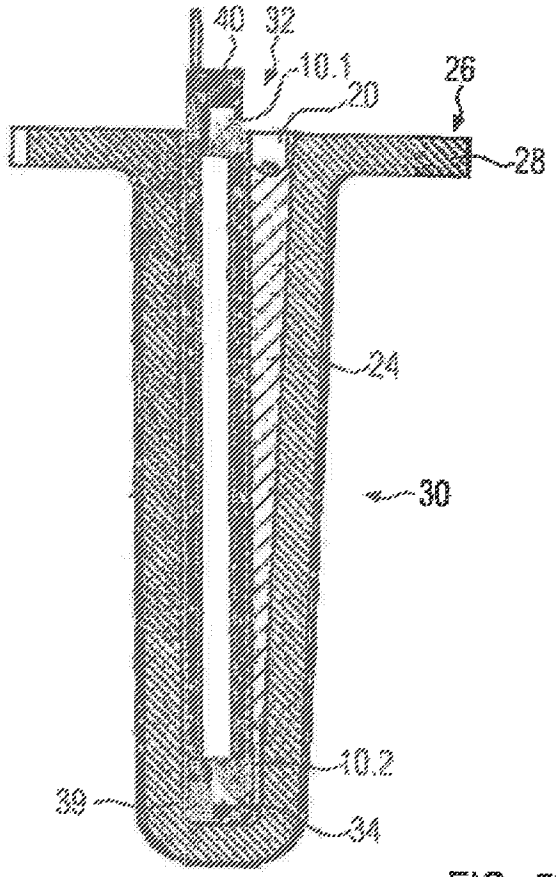
FIG. 5 is a cross-sectional view of a heating rib of an embodiment, not shown in further detail, of an electric heating device after insertion of a fourth embodiment of a PTC heating element according to FIG. 1, 2 together with the slide sheet according to FIG. 4.
Figure 6:
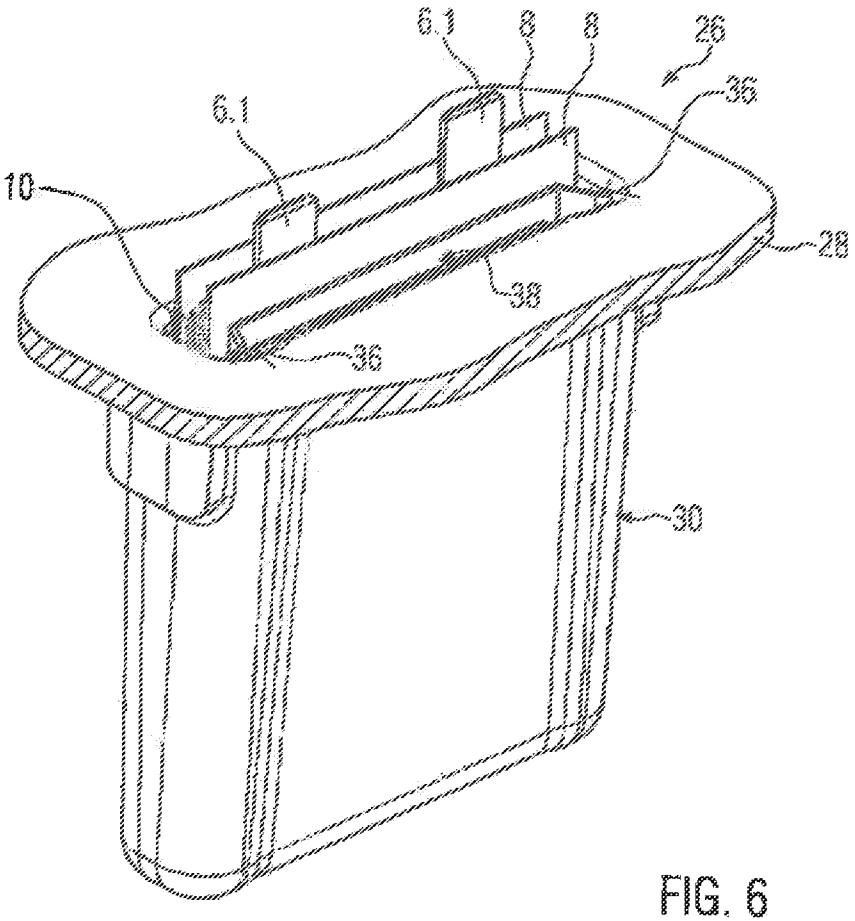
FIG. 6 is a perspective, partly cut, illustration of an embodiment, not shown in further detail, of an electric heating device after insertion of a fourth embodiment of a PTC heating element according to FIG. 9.

FIGS. 5 and 6 illustrate the installation situation of a PTC heating element 2 received in the U-shaped receptacle 16 of the slide sheet 14. Reference numeral 26 marks a part of a housing top which can be mounted on a tub-shaped housing base (not shown) to form a circulation chamber for liquid medium to be heated, as is known from EP 1 872 986 A1. The content of disclosure of this publication—as far as it regards the heating device as such and particularly the details of housing base and housing top—is incorporated by this reference into the disclosure of the present application.

The housing top 26 comprises a partition 28, which normally extends in parallel with the bottom of the housing base, and usually plural heating ribs 30 which project at a right angle from said partition 28 and which open via a U-shaped recess 32 towards a connection side of a heater for liquid media (particularly water heaters).

The unit consisting of PTC heating element 2 and slide sheet 14, which has previously been pre-installed by insertion into the U-shaped receptacle 16 of the slide sheet 14, is inserted into the U-shaped recess, namely to such a depth that the end side of the slide sheet 14 bent into a U-shape is seated on a bottom 34 of the U-shaped recess 32.

As can be seen from FIG. 6, the U-shaped recess 32 comprises lateral guide grooves 36 which extend in insertion direction and enlarge the U-shaped recess 32 at the edge and in thickness direction. These guide grooves 36 form receptacles for the spacers 20, in which the slide sheet 14 is guided and positioned during insertion of the slide sheet 14 with the PTC heating element 2. The spacers 20 expose a wedge-element receiving opening 38 by pressing against inner walls of the U-shaped recess 32, with the wedge element 24 being inserted into said opening after complete insertion of the slide sheet 14 with the PTC heating element 2. The wedge element 24 is provided at least at one side, preferably on opposite main side surfaces, with a water-based PTFE sliding lacquer with organic binder. Alternatively or in addition, such a sliding lacquer may be provided on an abutment surface formed by the U-shaped recess 32 for the wedge element 24 and/or on the slide surface 18. Such a coating serves as a dry lubrication during the insertion movement of the wedge element 24. The slide-reducing coating ensures reproducible mounting results because surface roughness, or the like, which may vary during the production of the individual components, is compensated by the coating. Thus, substantially the same introduction forces are required for placing different PTC heating elements 2 at a predetermined surface pressure against opposing inner surfaces of one of the U-shaped recesses 32. This pressing operation serves, on the one hand, the high emission of heat out of the PTC element 4 into the inner surfaces of the U-shaped recess and, on the other hand, current input from the contact surfaces of the PTC heating element 2 into the PTC element 4.

As can be learnt from FIGS. 1 to 6 in their entirety, the insulating layers that may be formed by the hybrid film 8 or by the insulation layers 12 project over the slide sheet 14 in width direction on the outside of the strip conductors 6 and project over the slide sheet 14 further in height direction towards the connecting lugs 6.1. The insulating layers project at least over the portion in which the slide sheet 14 directly adjoins the insulating layers (cf. FIG. 6). This increases the air gap and creep distance between the strip conductors and the housing top 26 and thus the electrical safety of the heating device. In addition the bead of the insulating mass 10 is also positioned above the PTC element 4 and thus between the connecting lugs 6.1 of different polarity. This also increases the creep distance. In actual fact, at least one of the strip conductors 6 is encompassed over the whole circumference by the mass 10, thereby providing high protection against leakage current. The other one of the two strip conductors 6 may be exposed circumferentially.

Figure 7:
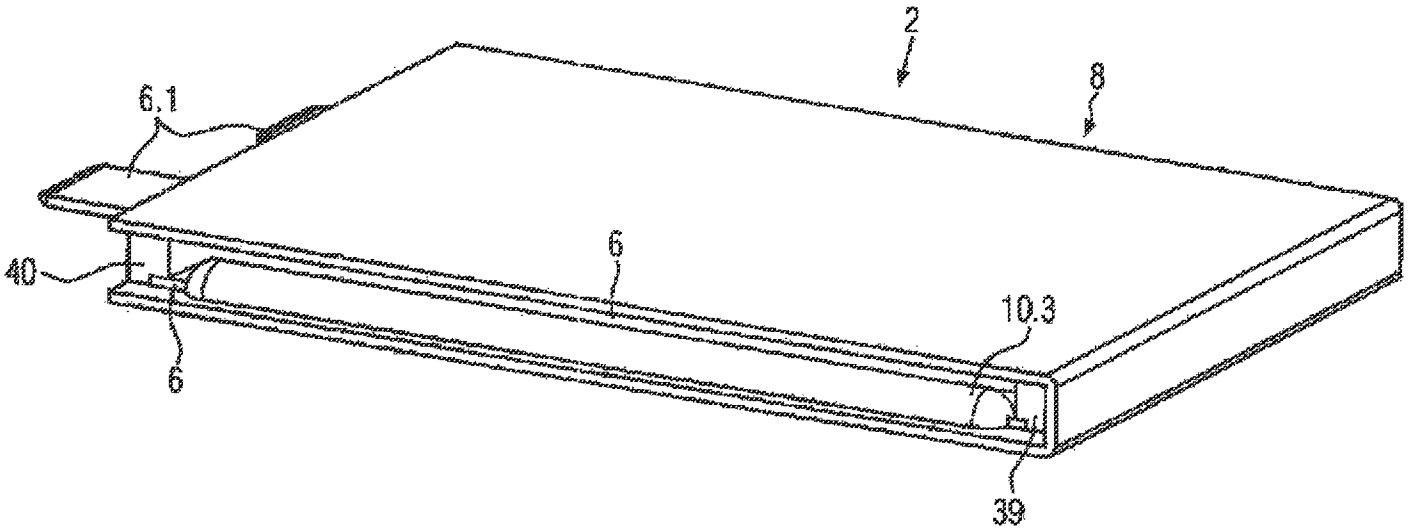
FIG. 7 is a perspective side view of a third embodiment of a PTC heating element.

In the third embodiment according to FIG. 7, strip conductors 6 are formed by metal sheets. As has been described above, the metal sheets comprise connecting lugs 6.1 which are cut free by punching and are used for the electrical connection of the contact sheets 6. As can be learnt from FIG. 8 which is submitted for the further illustration of this embodiment and in which the longitudinal-side beads of the mass 10 have been removed for reasons of a better visibility of the details, each of the contact sheets 6 ends flush with the PTC element 4. In a direction at a right angle thereto, i.e. in the joining direction, the contact plates 6 respectively project over the PTC element 4, at both sides. Each adjoins a bar 39 and 40, respectively. The two bars 39, 40 have a thickness conforming to the thickness of the PTC heating element 2 plus the two thicknesses of the contact sheets 6. Thus, a flat outer surface is formed on the outside by the side surfaces of the bars 39, 40 on the one hand and the outer surfaces of the contact plates 6 on the other hand.

Each of the bars 39, 40 has inwardly projecting abutment webs 42, each forming abutment surfaces for the contact sheets 6. The bars 39, 40 are provided at a distance from the opposite front face of the PTC element 4. In other words, a free space remains between a free front face of the respective abutment web 42 and the face of the PTC element 4.

Figure 8:
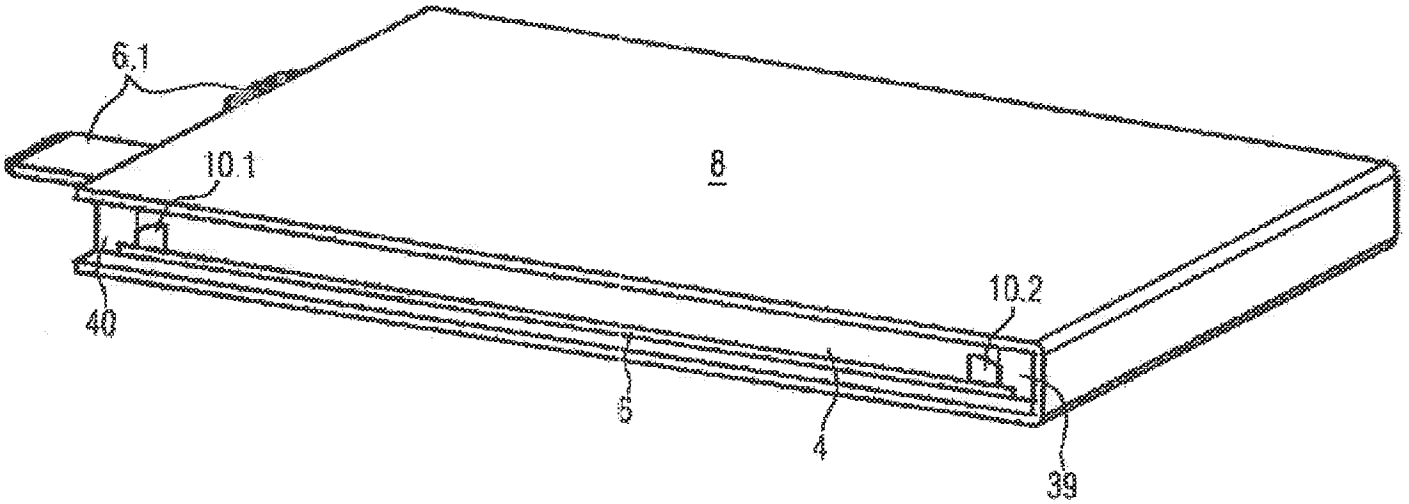
FIG. 8 shows the embodiment shown in FIG. 7 with a partly removed mass.

As illustrated in FIGS. 7 and 8, the PTC element is also sealed in this embodiment over the whole circumference by the bead consisting of the insulating mass 10. Like in the above-discussed embodiment, the mass 10 need not extend over the whole thickness of the PTC element 4.

On the longitudinal sides, the bead consisting of mass 10 is positioned on the hybrid film 8, which is illustrated in FIG. 7 in an already folded-over state, and covers the strip conductor 6, which is the lower one in FIG. 7, almost completely on the front side and a part of the PTC element 4 on the front side. The PTC element 4 is surrounded over the whole circumference by the mass 10. At opposite front sides, i.e. in the neighborhood of the bars 39, 40, the mass 10 serves not only to increase the creep distance and air gap at the front side of the PTC element 4, but also serves as an adhesive which connects the bars 39, 40 to the associated strip conductor 6. The bead 10.1, 10.2, which is shown in FIG. 8 and consists of electrically insulating mass 10, bridges the intermediate space between the abutment web 42 and the opposite front side of the PTC element 4. This lays the air gap and creep distance at the front sides between the strip conductors 6 of different polarity.

It goes without saying that the bead 10.3 of the mass 10, which is shown in FIG. 7 at the longitudinal side, can also extend over the whole longitudinal extension of the strip conductor 6 and can fully cover it in a corresponding manner at the longitudinal side.

An essential aspect of the present invention can however also be gathered from FIG. 8, according to which the mass 10 is applied to a projecting edge of the insulating layer (here the hybrid film 8) so as to cover one of the strip conductors 6 and the PTC element 4 for increasing the air gap and creep distance at the front side.

Figure 9:
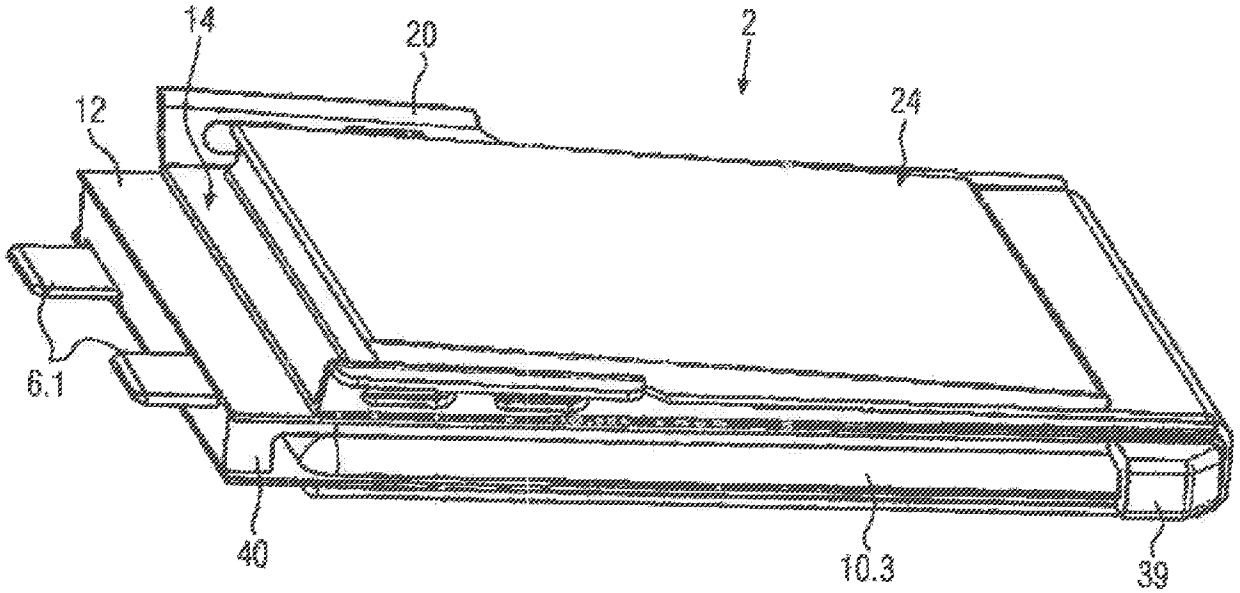
FIG. 9 is a perspective side view of a fourth embodiment of a PTC heating element.

Viewed together, FIGS. 5 and 9 reveal a further modified embodiment of a PTC heating element 2. In this PTC heating element 2, the upper bar 40 is given an L-shape, resulting in a relatively large abutment leg for the abutment of the insulating layer 12. As in the above-discussed embodiment according to FIGS. 7 and 8, the upper bar 40 has recesses which are fitted for the passage of the connecting lugs 6.1. The configuration of the slide sheet 14 installed in FIG. 9 corresponds to the embodiment according to FIGS. 4 and 6. Thus the slide sheet 14 encloses the lower bar 39. The lower bar 39 is positioned on the inside on a cross web of the U-shaped receptacle 16 of the slide sheet 14 (cf. FIG. 5). The lower bar 39 projects in the present case in width direction over the insulating layer 12 and also the slide sheet 14, grips partly around the longitudinal-side bead 10.3 and forms a stop for the relative positioning of neighboring PTC heating elements 2 in an elongated U-shaped recess of a heating rib. The lower bar 39 may be a plastic injection-molded part.

One or both bars 39, 40 can be connected by overmolding to the contact sheets 6; to this end at the level of a corresponding bar a contact sheet may comprise bores into which a plastic forming the bar can enter in the molten state to connect the bar in a form ft manner to the contact sheet. The other contact sheet is normally glued against the other bar. The mass 10 can also be used for filling a free space between the bar and the PTC element 4 and/or to connect the bar 39 to the PTC element 4.

The lower bar 39 normally comprises slightly rounded outer edges, especially when the hybrid film 8 is to be folded at the end side around the bar 39. The rounded edges reduce the risk of damage to the hybrid film 8 during installation.

What is claimed is:

1. A PTC heating element comprising:

at least one PTC element provided between strip conductors, an insulating mass sealing at least one of the strip conductors and/or the PTC element over an entire circumference thereof, wherein the insulating mass is applied as a glue bead which seals the at least one of the strip conductors and/or the PTC element circumferentially, an insulation layer which projects over an end side of one of the strip conductors, and which, with the strip conductor and/or the PTC element, defines a receiving portion receiving the insulating mass, and a slide sheet lying against the insulation layer.

2. A PTC heating element according to claim 1, wherein the insulating mass in thickness direction partly surrounds the PTC element and one of the strip conductors.

3. A PTC heating element according to claim 1, wherein the insulation layer and/or the slide sheet projects over the PTC element and the strip conductor at an edge thereof, and wherein the insulating mass seals at least one strip conductor and/or the PTC element at the edge thereof.

4. A PTC heating element according to claim 3, wherein the slide sheet comprises at least one spacer which is formed by punching and bending from a sheet material forming the slide sheet and by which the PTC heating element can be held at a predetermined distance from an inner surface of a U-shaped recess of an electric heating device.

5. A PTC heating, element according to claim 1, wherein the slide sheet comprises at least one spacer which is formed by punching and bending from a sheet material forming the slide sheet and by which the PTC heating element can be held at a predetermined distance from an inner surface of a U-shaped recess of an electric heating device.

6. A PTC heating element according to claim 1, wherein two strip conductors project over the PTC element at end sides thereof and lie at the end sides against at least one bar, the thickness of which does not exceed the thickness of the PTC element plus the thickness of the two strip conductors.

7. A PTC heating element according to claim 6, wherein the bar is glued to the PTC element by the insulating mass, wherein the insulating mass is formed as an adhesive insulating mass and seals the at least one strip conductor and/or the PTC element at the end side.

8. PTC heating element according to claim 1, wherein the insulating mass is formed as an adhesive insulating mass and is applied to an insulation layer to surround the PTC element, and wherein the insulating layer covers at least an outer surface of the at least one strip conductor that faces away from the PTC element.

9. An electric heating device for an automotive vehicle, comprising:

heat-emitting surfaces; and at least one PTC heating element located between the heat-emitting surfaces, wherein the PTC heating element comprises a PTC element which is contacted at opposed sides thereof with strip conductors which serve as an electrical connection for the PTC element, and wherein at least one of the strip conductors is provided with an insulation layer on an outer surface thereof facing away from the PTC element, and wherein an insulating mass seals at least one strip conductor and the PTC element over an entire circumference thereof, wherein the heat-emitting surfaces are formed by opposite inner surfaces of a U-shaped recess of a heater housing, and wherein an electrically insulating mass is provided only between the inner surfaces of the U-shaped recess and a front side of the PTC heating element.

10. A method for producing an electric heating device comprising at least one PTC element provided between strip conductors, the method comprising:

gluing the strip conductors to the PTC element to produce a PTC heating cell, and sealing at least one of the strip conductors and/or the PTC element over an entire circumference by an electrically insulating mass, wherein the PTC heating cell is placed with one of the strip conductors on an insulating film, wherein the insulating mass is applied against projecting edges of the insulating film, and wherein the insulating film is folded in for the sealing inclusion of the PTC heating cell and is placed on the other one of the strip conductors.

11. A method according to claim 10, wherein the sealing comprises laying the insulating mass as a surrounding glue bead circumferentially against the strip conductor and at least in part against the PTC element.

* * * * *